US008944076B1

(12) United States Patent
Doubt

(10) Patent No.: US 8,944,076 B1
(45) Date of Patent: Feb. 3, 2015

(54) SYSTEM AND METHOD FOR INCREASING HAIR VOLUME

(71) Applicant: Ruxton C. Doubt, Kent, WA (US)

(72) Inventor: Ruxton C. Doubt, Kent, WA (US)

( * ) Notice: Subject to any disclaimer, the term of this patent is extended or adjusted under 35 U.S.C. 154(b) by 0 days.

(21) Appl. No.: 14/257,786

(22) Filed: Apr. 21, 2014

(51) Int. Cl.
*A41G 5/00* (2006.01)

(52) U.S. Cl.
CPC ..... *A41G 5/008* (2013.01); *A41G 5/004* (2013.01)
USPC ..... 132/201; 132/53

(58) Field of Classification Search
USPC ..... 132/201, 53–56; 24/69 AT, 714.8
See application file for complete search history.

(56) References Cited

U.S. PATENT DOCUMENTS

| | | | | |
|---|---|---|---|---|
| 3,295,534 | A | 1/1967 | Dorkin | |
| 4,934,387 | A | 6/1990 | Megna | |
| 5,107,867 | A | 4/1992 | Barrington | |
| 5,752,530 | A | 5/1998 | Traintinger | |
| 5,787,747 | A * | 8/1998 | Bevk et al. | 72/16.5 |
| 5,894,846 | A | 4/1999 | Gang | |
| 5,937,867 | A * | 8/1999 | Williams | 132/201 |
| 6,820,625 | B2 | 11/2004 | Park | |
| 6,837,249 | B2 | 1/2005 | Smith | |
| 7,192,635 | B2 * | 3/2007 | Ott | 428/122 |
| 7,614,403 | B2 | 11/2009 | Nomura | |
| 7,726,321 | B2 | 6/2010 | Arroyo et al. | |
| 2004/0173233 | A1 * | 9/2004 | Tokko | 132/201 |

* cited by examiner

*Primary Examiner* — Rachel Steitz
(74) *Attorney, Agent, or Firm* — Seed IP Law Group PLLC

(57) ABSTRACT

A system, comprising: a sleeve having a circumscribing sidewall formed of elastic, compliant material, the sleeve having an internal axial bore sized to have an inside diameter equal to or less than an outside diameter of a host hair to be received in the bore, the sidewall formed of thermoplastic resilient, compliant material, and at least one supplemental hair embedded in the sidewall or attached to the sidewall of the sleeve.

13 Claims, 7 Drawing Sheets

SYSTEM AND METHOD FOR INCREASING HAIR VOLUME

BACKGROUND

1. Technical Field

The present disclosure is directed to supplementing existing human hair and, more particularly, to adding volume by attachment of additional hair strands to a host strand of hair.

2. Description of the Related Art

It is known that hair transplants only achieve a 30% to 50% increase in hair density. While an increase of 50% in hair density generally looks better, a lower density of hair improvement usually presents a thin head of hair. Ideally, the goal is to obtain a thickening of 100% or more of existing hair.

Prior methods are problematic because of limitations on reusability. For example, adhesives have been used to glue or bond additional hair to an existing hair shaft. The difficulty with adhesives is that they are exposed to the elements, such as rain, the ocean, sweat, as well as chemicals from shampoo, which can break down the adhesive. When the adhesive breaks down, the bond fails, resulting in hair loss.

Other methods and devices include the use of metal clamps. Such clamps require special tools to attach the clamp to the hair. In order to adjust and accommodate growing hair, the clamps must be unclamped and reclamped, resulting in tedious and expensive labor. Metal fatigue is also an issue with these types of clamps. Moreover, the use of thousands of clamps in a head of hair may cause allergic reactions, and these clamps can be easily snagged or pulled with a comb or brush.

Another approach has been to use thermal plastic tubes that are shrunk onto the hair with the application of heat. Such heat shrunk tubes are difficult to adjust because they require reheating, which can be damaging to existing hair and the scalp, and such tubes are usually not able to be reheated and reapplied.

In general, existing methods and devices are one-time applications only. The practicality of attempting to adjust these existing hair supplementation devices while attached to the existing hair makes them unusable for all intents and purposes.

BRIEF SUMMARY

The present disclosure is directed to a system and method for supplementing existing hair, which can include thickening of the hair and adding hair extensions to host hair to increase volume, such as density or length or both.

In accordance with one aspect of the disclosure, the system includes a sleeve or thin tube formed from a sidewall having an internal axial bore. Ideally, the sidewall is formed of thermoplastic resilient or compliant material that is unaffected by UV and saltwater exposure. The system also includes at least one supplemental hair attached to the sidewall of the sleeve or tube. Ideally, the supplemental hair is a user's own hair that has fallen out or been cut. The internal axial bore of the tube is sized to have a diameter equal to or less than a diameter of a host hair to enable the tube to elastically grip the host hair when the tube is placed over the host hair.

In accordance with one aspect of the present disclosure, a system is provided to increase hair density of existing hair, the system including a sleeve having a cylindrical body with an interior surface and opposing exterior surface, the body further including first and second ends and a longitudinal slit formed in the body and entire length of the sleeve from the first end to the second end, the slit having a width defined by a distance between a first sidewall and a second sidewall of the sleeve body; a plurality of hair strands embedded in the sleeve body or attached to the exterior surface of the body; and an attachment system configured to attach the sleeve to one hair shaft of the existing hair.

In accordance with a further aspect of the present disclosure, a method of increasing hair density of existing hair is provided, the method including (a) attaching to a shaft of hair of the existing hair a sleeve having a cylindrical body with an interior surface and opposing exterior surface and a plurality of hair strands embedded in the body or attached to the exterior surface of the body, the body further including first and second ends and a longitudinal slit formed in the body an entire length of the sleeve from the first end to the second end, the slit having a width defined by a distance between a first sidewall and a second sidewall of the sleeve body; and (b) securing the sleeve to the shaft of hair to enable the sleeve to move in one direction on the shaft of hair and resist movement in an opposite direction on the shaft of hair.

In accordance with still yet a further aspect of the present disclosure, a system is provided that includes a sleeve having a circumscribing sidewall formed of elastic, compliant material, the sleeve having an internal axial bore sized to have a diameter equal to or less than a diameter of a host hair to be received in the bore, the sidewall formed of thermoplastic resilient, compliant material; and at least one supplemental hair attached to the sidewall of the sleeve.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures or components or both associated with hair care, including but not limited to hair lubricants, have not been shown or described in order to avoid unnecessarily obscuring descriptions of the embodiments.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one embodiment" or "an embodiment" means that a particular feature, structure, or characteristic described in connection with the embodiment is included in at least one embodiment. Thus, the appearance of the phrases "in one embodiment" or "in an embodiment" in various places throughout the specification are not necessarily all referring to the same embodiment. Furthermore, the particular features, structures, or characteristics may be combined in any suitable manner in one or more embodiments.

The present disclosure is directed to a system and method of using an elastic sleeve (or tube) to attach several hairs (synthetic or real) to a host hair growing out of the scalp. In so doing the hair density (number of hairs per square inch on the scalp) will be increased, giving the prospective user the potential for a full head of hair. In order to provide the installer of the sleeve with a product which provides this increase of hair density, several procedures are involved.

By "attach" and "attachment" of hair, the present disclosure is intended to embrace known means of connecting or coupling hair to a substrate, including without limitation embedding a portion of hair or synthetic hair into a substrate, as described more fully below. Attachment can also include attaching the hair to the exterior surface of the substrate, such as with adhesive or fusion or by other well-known processes that will not be described herein. In addition, increasing volume includes thickening of the hair or lengthening of the hair or both.

Figure 1:
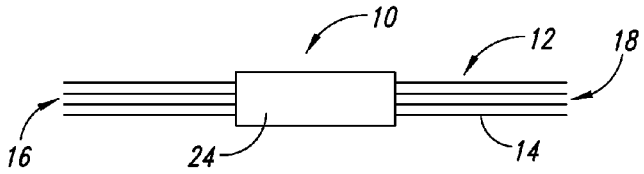
FIG. 1 is a side view of an insulated cable prepared for attachment of supplemental hair in accordance with the present disclosure.

Referring initially to FIG. 1, shown therein is a sleeve 10 mounted on a four-wire cable 12. Ideally, the sleeve 10 is constructed from OM3060 Thermoplastic available from PolyOne Corporation. This material is used as insulation over the cable 12 and is available from Calmont Corporation. In other words, the insulated cable 12 uses the thermoplastic insulation from PolyOne Corporation. The insulation is used as an encasing for the four strands of preferably 54-gauge stainless steel wire, which are intertwined.

As shown in FIG. 1, the cable is formed of four individual wires 14 that are exposed on each end of the sleeve 10. In other words, the insulated cable is partially stripped, leaving the sleeve 10, which is approximately 1/16" to 1/2" in length and ideally 1/4" in length. The sleeve 10 is situated between the exposed ends 16, 18 of the cable 12. Ideally each exposed end 16, 18 is about 1" in length.

At this stage, supplemental hairs, approximately 2 to 7 hairs, and more preferably 3 to 6 hairs, are attached to the sleeve 10. The attachment may be either with adhesive or the hairs may be partially embedded or completely embedded into the thermoplastic sleeve 10.

Figure 2:
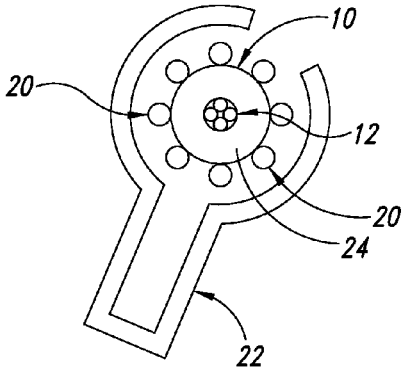
FIG. 2 is a cross-sectional view of the tube of the present disclosure having the supplemental hair clamped to an exterior surface in accordance with the present disclosure.
Figure 3:
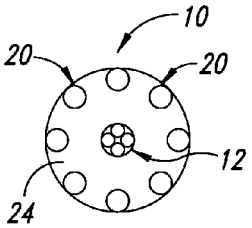
FIG. 3 is a cross-sectional side view of the supplemental hairs embedded in the sidewall of the tube in accordance with the present disclosure.
Figure 4:
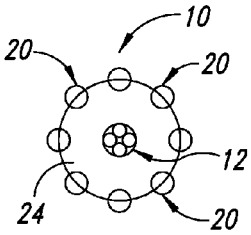
FIG. 4 is a cross-sectional view of the supplemental hair partially embedded in the sidewall of the tube in accordance with the present disclosure with a host hair inserted in the internal axial bore.

If it is desired to embed the hairs into the sleeve 10, the sleeve should first be heated to soften the material. This can be done by running current through the cable 12 to cause the wires 14 to heat up, transferring the heat to the sleeve 10, preferably only the amount of heat needed to sufficiently soften the thermoplastic sleeve 10 and allow the supplemental hairs to be pushed into it. Referring to FIG. 2, shown therein is an end view of the cable 12 and the sleeve 10 having a plurality of supplemental hairs 20 positioned around the outside perimeter of the sleeve 10. A clamp tool 22 is sized and shaped to encircle the sleeve 10 and press the hairs 20 into the softened sleeve 10. As shown in FIG. 3, the hairs 20 are completely embedded in a sidewall 24 of the sleeve 10. Alternatively, as shown in FIG. 4, one or more of the supplemental hairs 20 can be partially embedded in the sidewall 24 of the sleeve 10. This is done by controlling the amount of compression exerted by the tool 22 on the hairs 20. Alternatively, the hairs can remain attached to the outside of the sidewall 24 of the sleeve 10 as shown in FIG. 2.

Figure 5:
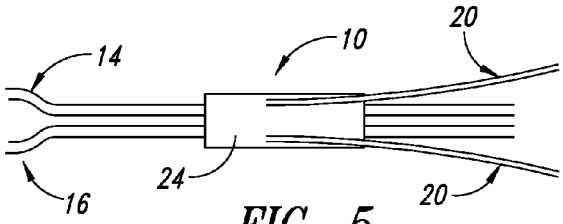
FIG. 5 is a side cross-sectional view of the supplemental hair embedded in the tube when mounted to the cable.
Figure 6:
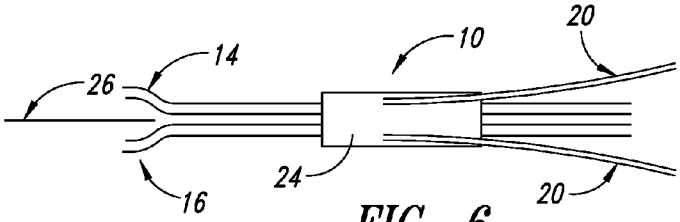
FIG. 6 is a side cross-sectional view of the host hair slid into the deployed wires.
Figure 7:
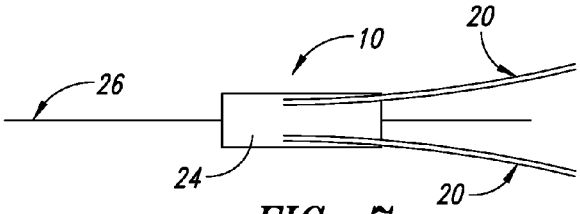
FIG. 7 is a side cross-sectional view of the tube received over the host hair in accordance with the present disclosure.

Referring next to FIG. 5, shown therein is the sleeve 10 having the supplemental hairs 20 embedded in the sidewall 24. In order to prepare the sleeve 10 for mounting on a host hair, the wires 14 on the first end 16 are spread apart to allow the host hair 26 (see FIG. 6) to be inserted between the wire strands 14.

Ideally before the hairs 20 are immersed or embedded into the sleeve 10, they may be treated with a temporary adhesive or adhesion promoter, such as a silane. Also, before the supplemental hairs 20 are attached to the sleeve, the sleeve inside diameter is selected in accordance with the size of the host hair. Thus, the host hair is first measured to determine its diameter, and then a cable 12 with insulation is selected having an inside diameter of the sleeve 10 that is in the range of approximately 1/4 the outside diameter of the host hair up to and including the actual outside diameter of the hair.

It is to be understood that the wall thickness of the sleeve 10 may vary, but should be a sufficient thickness to enable complete immersion of the supplemental hairs 20. While the sleeve's outer circumference can be several times larger than the diameter of the supplemental hairs 20, it will not necessarily be visible. However, if visibility of the sleeve 10 is seen as an advantage, such as for decoration or highlighting, the supplemental hairs 20 that are attached or embedded into the sleeve 10 can be partially embedded such that upon close inspection, several hairs can be seen converging at the scalp at the same place. Because this convergence is surrounded by a substantial number of other similar convergences, it will become difficult to notice anything unusual.

In order to render the sleeve 10 ready for installation on the host hair 26, two additional preparation steps may be needed.

First, the wire cable 12 may need to be heated in order to enable the sleeve 10 to be dislodged from the wire cable 12. The sleeve should be able to slide freely so that the user or installer will be able to slide the sleeve with minimal effort off the wire cable 12.

Secondly, the wires on the first end 16 are separated as described above to form a receiving opening to capture the host hair 26.

The host hair 26 may need a stiffening agent applied to it so that it will remain sufficiently rigid to be guided into the mouth of the parted wires 14. After the host hair 26 is situated among the wires 14, the movement of the sleeve sliding down the wires 14 towards the first end 16 will cause the wires 14 to clamp down and surround the host hair 26, thus holding the host hair 26 in place. Alternatively, a tool may be used to initially clamp the wires 14 around the host hair 26 until the sleeve is sufficiently slid towards the first end 16 to allow the clamping tool to be removed without risking the host hair 26 being pushed out from between the wires 14.

Although the inside diameter of the sleeve is in the range of approximately ¼ the outside diameter of the host hair 26 up to and including the actual outside diameter of the host hair 26, the elastic nature of the thermoplastic sleeve allows it to stretch over the wires 14 that surround the host hair 26 and to slide onto the shaft of the host hair 26. To facilitate sliding of the sleeve 10 onto the host hair 26, the host hair 26 may be coated with vitamin E or other soluble lubricant that serves to lubricate the host hair 26. Ideally the lubrication is applied after the host hair 26 is placed between the wires 14.

Once the sleeve 10 slides past the ends of the wires 14 and is on the host hair 26, the wires 14 are pulled away, leaving the sleeve about 1" past the end of the host hair 26. At this point, the sleeve 10 can be slid further down the host hair 26. This is accomplished by holding the free end of the host hair 26 so that the hair is taut, such as with the fingers or an appropriate tool, while the sleeve is pushed down the shaft of the host hair 26 to meet the scalp. Once the sleeve 10 is in position, the vitamin E is removed from the host hair 26. As the host hair 26 grows out, adjustments in the location of the sleeve 10 along the host hair 26 will be needed. It is expected that this may be needed every 6 to 8 weeks, coinciding with a haircut. The installed sleeves can be pushed back down the host hair 26 to touch the scalp. If needed, lubricant can be placed on the host hair 26 to facilitate sliding of the sleeve 10.

It should be noted that choosing different inside diameters of the sleeve 10 enables a user to select more or less gripping power onto the host hair. In addition, thicker sidewalls 24 will provide more room for embedding of the supplemental hairs 20 therein, giving greater strength and more gripping power to the supplemental hairs 20. While a thicker sidewall 24 means a greater circumference, it also means that more supplemental hairs 20 can be attached thereto.

To comb out tangles, the host hair 26 can be held near the scalp, such as with the fingers, so that all force exerted by a comb or brush goes against the one hand and avoids pulling the sleeve away from the scalp.

Figure 8:
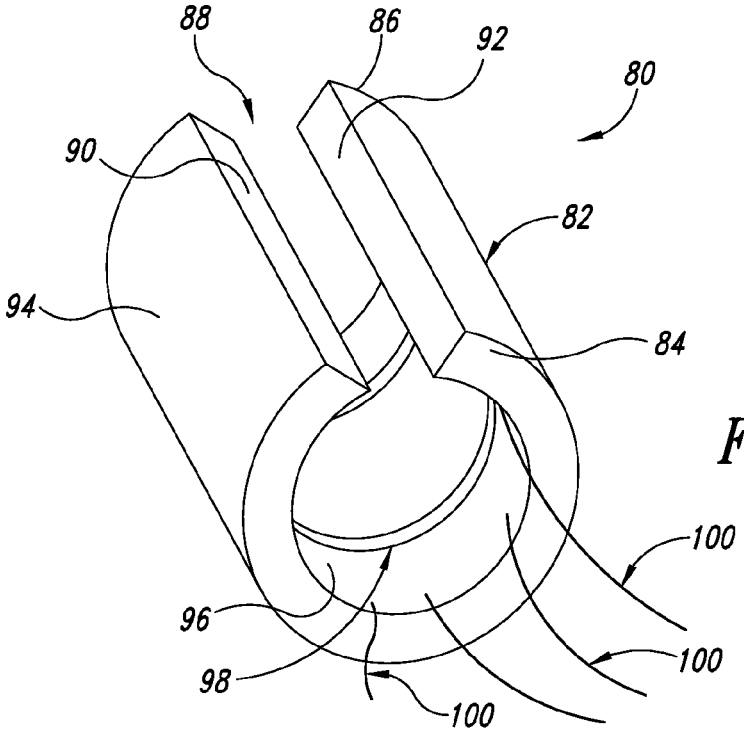
FIG. 8 is an isometric view of a sleeve formed in accordance with an alternative aspect of the present disclosure.
Figure 9:
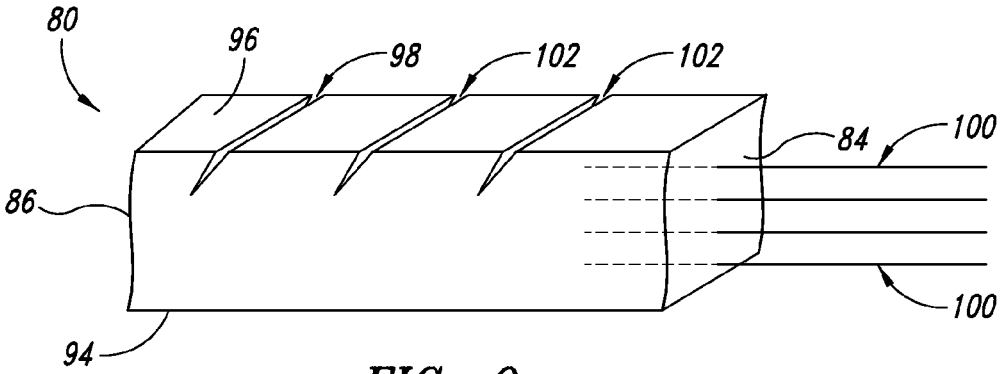
FIG. 9 is a partial view in cross section of the sleeve of FIG. 8 showing an internal construction thereof.

Reference is now made to FIGS. 8 and 9 in which is shown an alternative design of a sleeve 80 formed in accordance with the present disclosure for use in increasing hair density of existing hair. This alternative design is considered to be a preferred system and method of the present disclosure. The sleeve has a cylindrically shaped body 82 with first and second ends 84, 86, respectively, and a longitudinal slit 88 formed in the body 82 that extends an entire length of the sleeve 80 from the first end 84 to the second end 86. The slit 88 has a width that is defined by a distance between a first sidewall 90 and a second sidewall 92 in the sleeve body 82. The sleeve body 82 also has an exterior surface 94 that is substantially smooth, and an interior surface 96 that is also substantially smooth except for a plurality of angled cuts 98, described in more detail below. Extending from the first end 84 of the sleeve 80 are a plurality of hairs 100 that are embedded in the body 82 of the sleeve 80, as shown more clearly in the enlarged view of FIG. 9 showing the cuts 98 on the interior surface 96 of the sleeve body 82. As can be seen, the cuts 98 have a cross-sectional V-shape that is angled in one direction, in this case towards the second end 86. When the sleeve 80 is wrapped around and squeezed onto a host hair, the edges 102 of the cut 98 will bite into the host hair a slight distance and resist movement of the sleeve in a first direction on the host hair while allowing movement of the sleeve in a second opposing direction of the host hair. Preferably, the first direction is that which would allow the sleeve to be slide off the free end of the hair, and the opposing second direction would be in a direction toward the scalp from which the hair is growing. This allows the sleeve to be easily moved downward towards the scalp to adjust its position on the host hair as needed, such as in response to growing of the host hair out of the scalp.

Figure 10:
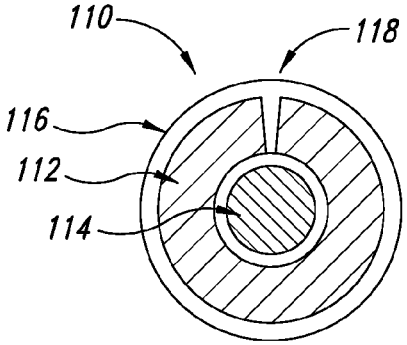
FIG. 10 is a cross-sectional view of the sleeve of FIG. 8 attached to a host hair with a clamp in accordance with the present disclosure.

Referring next to FIG. 10, shown therein is a system 110 to increase the density of an existing set of hair including a shaft of hair 114 to which a sleeve 112 is attached by a clamp 116. The clamp is secured around the sleeve 112 with a clamp mechanism 118. It is to be understood that the clamp 116 is one form of an attachment system for affixing the sleeve 112 to the host hair 114. In this aspect of the present disclosure, the clamp 116 is a band of high-strength elastic material, such as polyether ether ketone (one example of many plastics which would work) or other similar material that has a substantially cylindrical shape and is sized to fit over the exterior of the sleeve 112 and bear against the outer surface thereof. It is to be understood the sleeve 112 can be configured as described above with respect to FIGS. 8 and 9 or with respect to FIGS. 1-7 described earlier.

Figure 11:
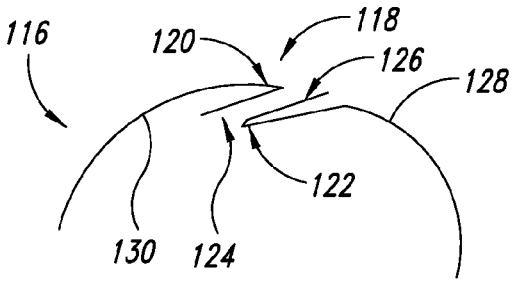
FIG. 11 is an enlarged view of the sleeve shown in FIG. 10.

FIG. 11 shows the clamp 116 in enlarged detail to have the free ends 120, 122 separated from one another. The first free end 120 has a first hook member 124 extending at an acute angle inward and away from the free end 120. Similarly, the other mating free end 122 has a second hook member 126 that extends at an acute angle from the second end 122 and away from an exterior surface 128 of the clamp 116. Thus, the first hook member 124 extends away from the interior surface 130 of the clamp 116 while the second hook member 126 extends away from the exterior surface 128 of the clamp 116. Each hook member may have a length in the range of 0.01 millimeter to 0.55 millimeter. The acute angle for each hook member 124, 126 is preferably no greater than 45 degrees, and in one aspect of the present disclosure, is in the range of 10 degrees to 35 degrees. Ideally, the length of each hook member 124, 126 is as small as possible to minimize the amount of surface area that could be visible or contacted by a brush or comb.

In use, the clamp 116 has the first and second ends 120, 122 squeezed together until the first hook member 124 slides up and beyond the second hook member 126 to snap in place between the second hook member 126 and the exterior 128 of the clamp 116. Pressure is then released on the clamp 116 to allow the first hook member 124 to seat in the space between the second hook member 126 and the exterior 128 of the clamp 116.

The clamp 116 can have a dimension that is substantially the same as the exterior dimension of the sleeve body 82 in terms of its length, or it can be shorter in length. The clamp mechanism 118 is dimensioned so as to force the clamp 116 to squeeze the sleeve 112 tightly around the shaft of the host hair 114. The compressibility of the sleeve will urge the clamp mechanism 118 to stay in engagement and prevent release of the sleeve 112 from the host hair 114.

Figure 12:
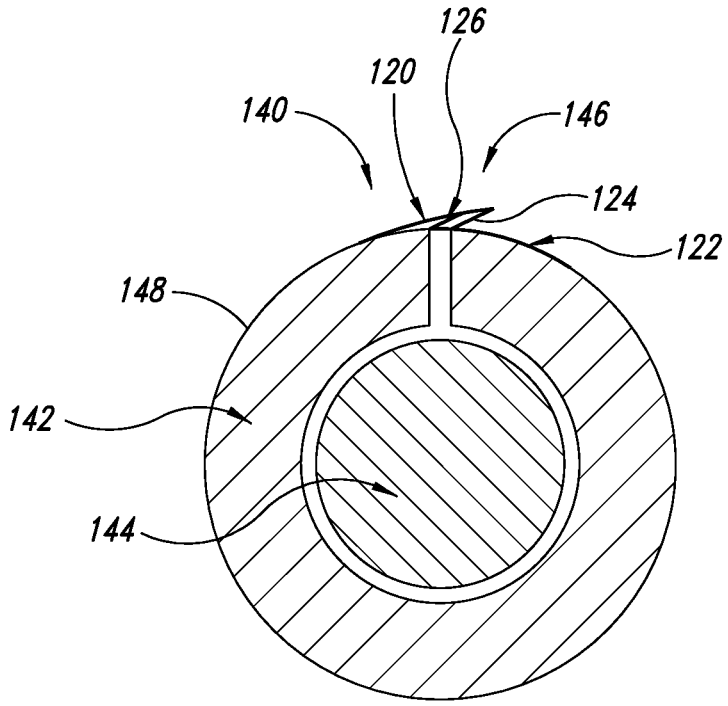
FIG. 12 is a cross-sectional view of a further aspect of the present disclosure in which the sleeve of FIG. 8 is reconfigured to incorporate the clamping mechanism of the clamp of FIG. 10 only at the ends thereof for attachment to a host hair.

FIG. 12 illustrates an alternative system 140 formed in accordance with the present disclosure in which a sleeve 142 is affixed to a host hair 144 by means of a clamp mechanism 146. In this design, the clamping mechanism 146 is integrally formed with the sleeve 142. More particularly, using the embodiment shown in FIG. 11, the first end 120 of the clamp mechanism 146 is adhered or mounted to the exterior surface 148 of the sleeve with the first hook member 124 extending towards the sleeve 142. The second end 122 is likewise integrally formed with or attached to the sleeve 142 and has the second hook member 126 extending away from the sleeve 142 at an acute angle as described above with respect to FIG. 11. When the sleeve 142 is squeezed, such as with a pair of pliers, the first hook member 124 will engage the second hook member 126 in a manner as described above with respect to FIG. 11.

The foregoing means for attachment systems for affixing the various configured sleeves to the host hair adopt a mechanical approach. An alternative approach would be to use only adhesive. This could be something as simple as the well-known SUPER GLUE product readily commercially available that would be applied to the interior surfaced of the sleeve or adjacent the first and second sidewalls of the slit of the sleeve. In addition, it can be applied to the sidewalls themselves, either exclusively or in combination with application to the interior surface of the sleeve. Alternatively or in combination therewith, a UV activated adhesive can be applied. This allows the adhesive to be added well in advance of the attachment of the sleeve to the host hair. Once the sleeve is in the desired location and position on the host hair, the adhesive is activated by the activation of UV light. An example of a UV activated adhesive suitable for the present system would be the Loctite 4310, which when exposed to UV light cures within 2-5 seconds. Preferably a very thin coating of this adhesive is applied, which facilitates a quicker cure rate.

To adjust the sleeve, the UV light is used to heat the adhesive, thus loosening the attachment to the hair and allowing the sleeve to be slid on the hair towards the scalp. The serrations or cuts 98 prevent or resist sliding of the sleeve in an opposite direction away from the scalp.

As an example of a method of applying the sleeve to the host hair, the adhesive is applied shortly before the sleeve is installed. A trough to hold the adhesive and a pair of pliers are used in which an assistant to the installer dips the sidewalls of the sleeve, which is held by pliers, into the solution such that only the sidewalls of the sleeve receive the adhesive. This ensures that the installer always has a sleeve waiting and ready for him or her with adhesive fresh and wet on the sidewalls of the slit of the sleeve. The installer then captures the host hair, such as with their fingers, and combs the remaining hair away to the side. The pliers hold the sleeve with the slit facing outward from the pliers and the slit open so as to move the sleeve on to the hair from the side of the hair. After the sleeve is positioned around the hair at the desired distance from the scalp, the pliers are used to clamp the sleeve around the host hair. The UV light is then directed on the sleeve and the adhesive, which cures in 2-3 seconds. The installer is then free to move to the next host hair.

In accordance with one aspect of the present disclosure, the UV light is mounted directly on the pliers such that it is ready to shine at the appropriate location when needed. A trigger-style switch is included on the pliers to activate and deactivate the light. The sleeve is squeezed or "squished" onto its location and will grip the host hair with sufficient force that it becomes very difficult to remove or slide off the host hair.

In addition to the foregoing gripping power, the cuts 98 previously described provide additional holding power. This holding power can be adjusted by the force applied when squishing the sleeve sidewalls together with the pliers.

Figure 13:
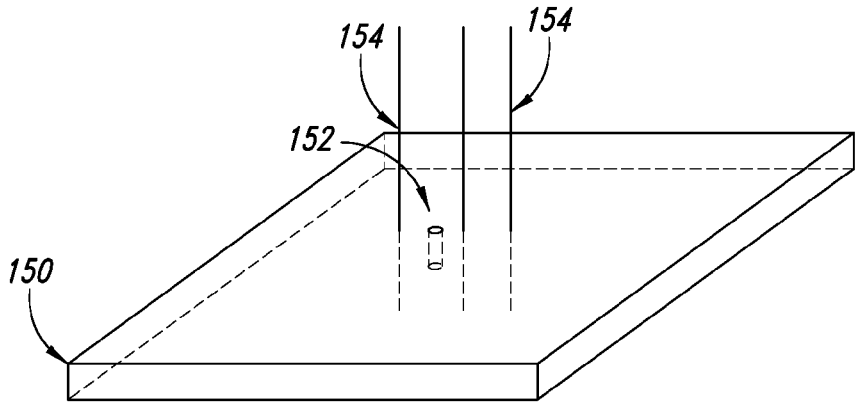
FIG. 13 is an isometric view of an initial step of a method in accordance with the present disclosure.

FIGS. 13-17 illustrate one preferred process for making a sleeve populated with hair (each hair inside the sleeve wall). The first step shown in FIG. 13 is to provide a sheet of thermoplastic material 150 dimensioned as described above. An opening 152 is completely through the sheet of thermoplastic material 150 with a diameter of 0.04 mm. This diameter represents the smallest diameter found for a human hair.

Figure 14:
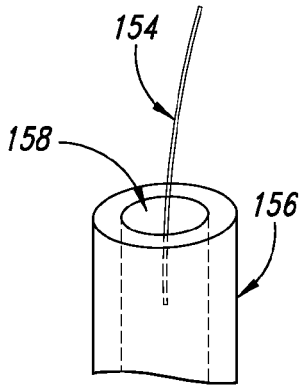
FIG. 14 illustrates a supplemental hair inserted into a pocket at the end of a needle in accordance with the present disclosure.
Figure 15:
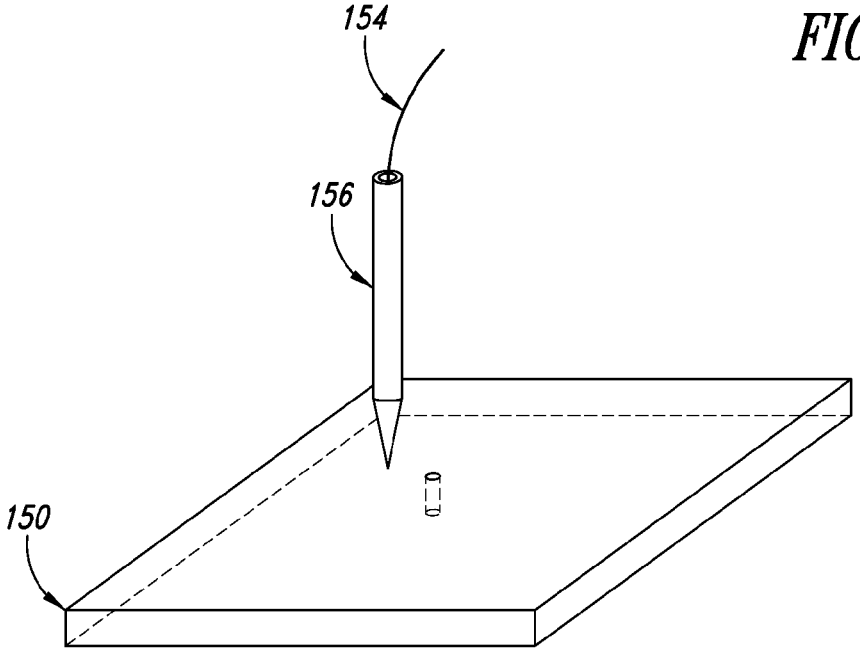
FIG. 15 is an isometric view of the needle and supplemental hair of FIG. 14 positioned for installation on the sheet of thermoplastic material.

The next step is to populate the sheet of thermoplastic with human (or synthetic) hair. To do this, a hair 154 is attached to the thermoplastic sleeve 150 by using a needle 156 having a diameter much larger than the diameter of the hair 154 as shown in FIG. 14. The needle can have a diameter as large as 0.2 mm, and at the end of the needle a "pocket" or cavity 158 has been formed. The hair 154 seats down in the pocket 158 of the needle 156 and is also glued into the pocket 158 with an adhesive or glue. This prevents the hair 154 from being pulled away from the needle 156 as it passes through the sheet of thermoplastic material 150. Pushing the needle 156 through the sleeve 150 as shown in FIG. 15 is not boring through the sleeve 150 but instead pushing the thermoplastic material aside. This ensures that the hair 154, which now has been pulled all the way through the material 150, will be held tightly by the thermoplastic material 150. This is in addition to the silane coating on the hair 154.

Figure 16:
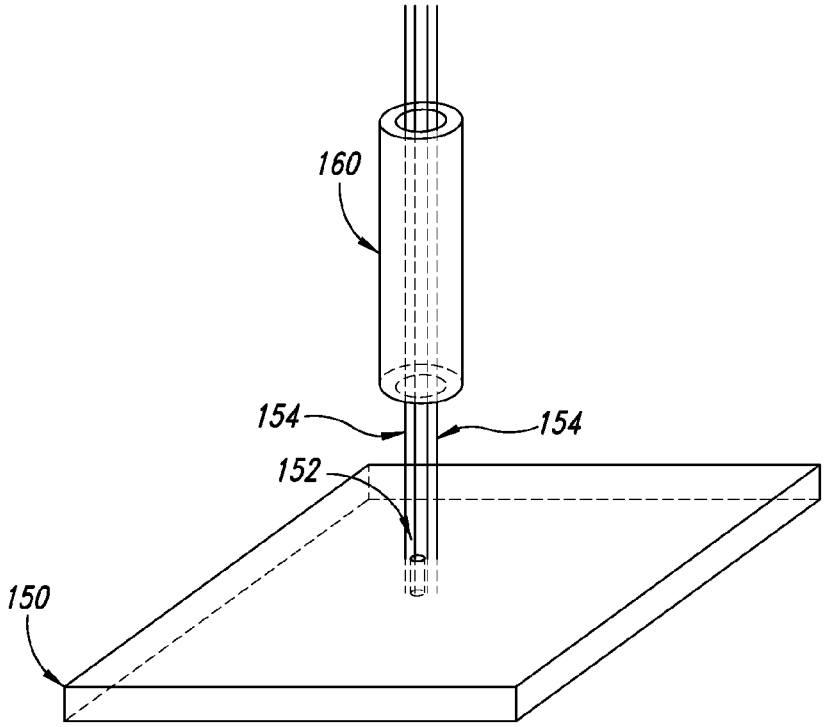
FIG. 16 is an isometric view of the formation of the sleeve from the sheet of thermoplastic material in accordance with the present disclosure.

Once several hairs 154 have been threaded through and attached to the sheet of thermoplastic 150, preferably in close proximity to what will be the center longitudinal bore of the eventual sleeve, a cylindrical micro tube 160 is placed over and engulfs all of the hair 154 as shown in FIG. 16. It comes down over the thermoplastic sheet 150 and bores a hole with a diameter of 0.5 mm through the sheet 150 to create a sleeve having a cylindrical shape. If the sheet 150 is very thin, it is possible for the sleeve to have a ring configuration, although this is not preferred.

Figure 17:
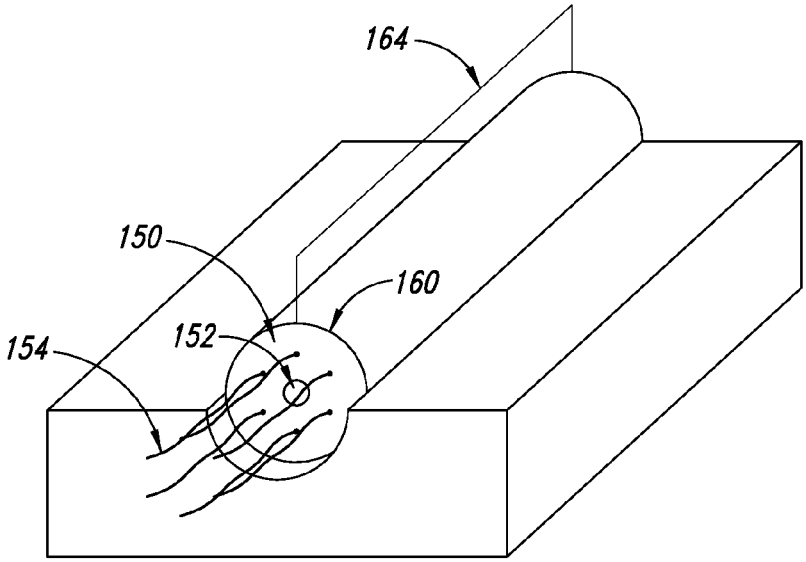
FIG. 17 is an isometric view of a trough and cutting tool used to form the slit in the sleeve in accordance with the present disclosure.

The cylindrical tube 160 with the hairs 154 embedded around the center hole 152 are then placed into a trough 162 for the purpose of splaying the tube down to the center hole. As shown in FIG. 17, a cutting tool 164 forms the longitudinal slit through the tube 160 and the cylindrical sheet 150 until it reaches the longitudinal opening 152. Once the slit is formed, the cylindrical clamp or the clamp members are attached to the exterior of the newly formed sleeve as previously described.

Figure 18:
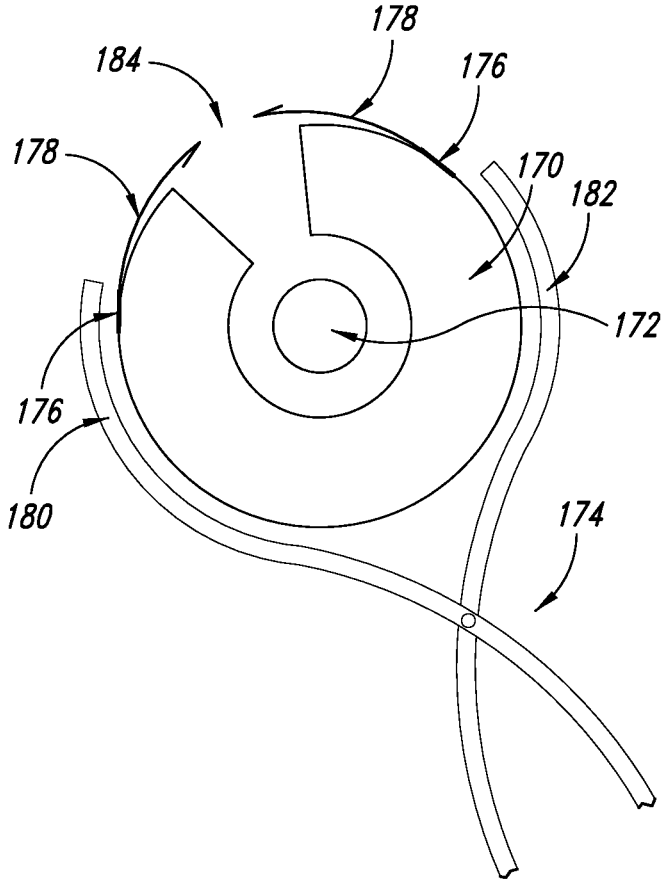
FIG. 18 is a top plan view of the sleeve with clamping members held in position over a host hair by pliers formed in accordance with the present disclosure.

FIG. 18 depicts a preferred method for attaching a thermoplastic sleeve 170 to a host hair 172. First, the host hair 172 is isolated by combing and then holding with one's fingers a single hair 172. A pair of pliers 174 are attached to the sleeve via the clamp members 176, 178 that in turn are attached to the sleeve 170 (as previously described). The pliers 174 are constructed so that the jaws 180, 182 hold the slit 184 in the sleeve 170 open sufficiently to slide the sleeve over the host hair 172. The pliers 174 with the sleeve 170 held in the jaws 180, 182 approaches the host hair 172 from the side of the host hair 172 and very close to the scalp. The user moves the sleeve 170 with external clamp members 180, 182 over to capture the host hair 172 (much like a hand gripping a pole). The pliers 174 are squeezed shut, thus locking the clamp members 180, 182 onto themselves as described above.

The distance of separation of one clamp member 180 from the other clamp member 182 is such that once the host hair 172 is captured and the pliers 174 lock the clamp members 180, 182 together, there will be an amount of gripping power assured. The thicker the sleeve, the tighter the squeeze, the greater the gripping power.

Figure 19:
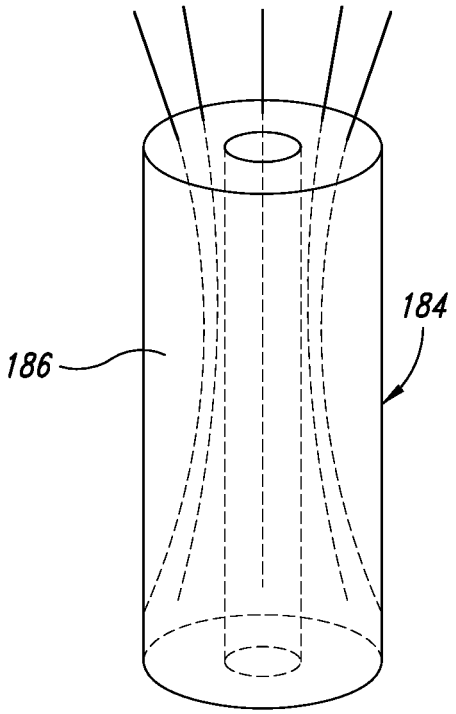
FIG. 19 is an isometric view of a large diameter sleeve formed in accordance with the present disclosure.

FIG. 19 represents a sleeve 184 with a large diameter that would allow hair to be embedded in to the wall 186 of the sleeve 184 at an angle. Even at one millimeter in diameter these sleeves are difficult to detect, especially when installed in the middle of the scalp near where the host hair meets the scalp and saturated with a substantial number of hair. The advantage to this "fat" sleeve is that the hair can be installed at angles to the surface, fewer installations are required, and the installations can be spaced further apart. Although FIG. 19 shows the hairs curved, they could be embedded with the needle at angles but still form straight lines.

Figure 20:
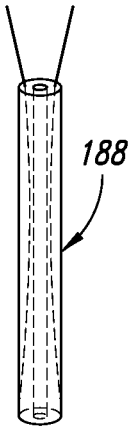
FIG. 20 is an isometric view of an ultra-thin sleeve formed in accordance with the present disclosure.

FIG. 20 is an example of a sleeve 188 that may be placed near the hairline, preferably near where the hair meets the forehead. This is an ultra-thin sleeve 188 that is difficult to detect. Both the larger sleeve 184 and ultra-thin sleeve 188 are slit along their lengths and have the clamps added to them to allow for the preferred method of installation. These sleeves are difficult to detect, more so because they are saturated with a substantial number of hairs. Also, the sleeve length itself may be shortened to possibly as short as 1/16" to help hide the sleeve near the scalp.

The various embodiments described above can be combined to provide further embodiments. The various aspects of the present disclosure can be modified, if necessary, to employ concepts of the various patents, applications and publications to provide yet further embodiments. For example, adhesive can be applied to the inside diameter of the sleeve (near the middle of the sleeve) which stays at a high viscosity at temperatures up to 110 degrees F., but once heated (via the pliers which serve to adjust the location of the sleeve, when needed) to a temperature of 140 degrees F., the adhesive "melts" (lowers the viscosity) and allows the sleeve to be moved to its new location. Once there, the pliers are released, the adhesive cools and "hardens" again, holding the sleeve firmly in place at its new location. This operating temperature of 140 degrees F. is safe to work with under these conditions and will not burn the scalp because the heat is localized. An example of an adhesive that could be used to coat the inside diameter of the sleeve is 3M Scotch-Weld hot melt adhesive 3792 LM AE clear. This adhesive has a "melting" point of 140 degrees F., i.e., it turns from a high viscosity to a low viscosity and then back to a high viscosity when allowed to cool.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A system to increase the appearance of volume of existing hair, the system comprising:

a sleeve having a cylindrical body with an interior surface and opposing exterior surface, the body including first and second ends and a longitudinal slit formed in the body and entire length of the sleeve from the first end to the second end, the slit having a width defined by a distance between a first sidewall and a second sidewall of the sleeve body, the interior surface of the body having at least one edge configured to engage the shaft of hair and permit sliding of the sleeve on the shaft of hair in a first direction and resist sliding of the sleeve on the shaft of hair in a direction opposite the first direction;

a plurality of hair strands integrally embedded in the body; and a clamp structured to clamp the sleeve to the shaft of hair, the clamp structured to remain on the sleeve and enable the sleeve to slide in the first longitudinal direction on the shaft of hair.

2. The system of claim 1, wherein the clamp is configured to encircle the sleeve and squeeze the sleeve onto the shaft of hair, the clamp structured to remain on the sleeve while enabling the sleeve to be slid in the first direction on the shaft of hair.

3. The system of claim 1, wherein the clamp comprises a first clamp member attached to the body adjacent the first sidewall and a second clamp member attached to the body adjacent the second sidewall, the first and second clamp members configured for making engagement to squeeze the sleeve onto the shaft of hair.

4. The system of claim 1, further comprising an adhesive that attaches the sleeve to the shaft of hair and is structured to temporarily lose adhesiveness to permit repositioning of the sleeve on the shaft of hair.

5. The system of claim 4, wherein the adhesive comprises UV light activated adhesive.

6. A method of increasing hair density of existing hair, the method comprising:

attaching to a shaft of hair of the existing hair a sleeve having a cylindrical body with an interior surface and opposing exterior surface and a plurality of hair strands integrally embedded in the body, the body further including first and second ends and a longitudinal slit formed in the body and entire length of the sleeve from the first end to the second end, the slit having a width defined by a distance between a first sidewall and a second sidewall of the sleeve body, the interior surface of the body having at least one edge configured to engage the shaft of hair and permitting sliding of the sleeve on the shaft of hair in an opposite direction; and securing the sleeve to the shaft of hair with a clamp to enable the sleeve to move in one direction on the shaft of hair and resist movement in an opposite direction on the shaft of hair.

7. The method of claim 6, further comprising repositioning the sleeve on the shaft of the hair in response to growth of the hair.

8. The method of claim 6, wherein the attaching comprises using an attachment clamp to attach the sleeve to the shaft of hair and remain on the sleeve to enable sliding of the sleeve on the shaft of hair in a first direction and prevent sliding of the sleeve on the shaft of hair in an opposing second direction.

9. A system, comprising:

a sleeve having a circumscribing sidewall formed of elastic, compliant material, the sleeve having an internal axial bore sized to have a diameter equal to or less than a diameter of a host hair to be received in the bore, the body having an interior surface with at least one edge configured to engage the shaft of hair and to prevent sliding of the sleeve in a first longitudinal direction on the host hair while permitting sliding of the sleeve on the host hair in an opposite longitudinal direction;

at least one supplemental hair integrally embedded in the sidewall of the sleeve to extend from the sleeve; and a clamp structured to clamp the sleeve to the host hair, the clamp structured to remain on the sleeve and enable the sleeve to slide in the first longitudinal direction on the host hair.

10. The system of claim 9, wherein the internal axial bore of the sleeve is in the range of ¼ the outside diameter of the host hair up to and including the actual outside diameter of the host hair.

11. The system of claim 9, wherein the sleeve is configured to be unaffected by UV and saltwater exposure.

12. The system of claim 9, wherein the at least one supplemental hair is embedded only in the sidewall of the sleeve.

13. The system of claim 9, further comprising a hot melt adhesive applied to the interior surface of the sleeve that is structured to adhere the sleeve to the host hair when the adhesive is set and to allow the sleeve to move relative to the hair when the adhesive is heated to a melting temperature of the adhesive.

* * * * *